United States Patent [19]

Fisher

[11] 4,370,863

[45] Feb. 1, 1983

[54] AIR CONDITIONER

[75] Inventor: J. D. Fisher, St. Louis, Mo.

[73] Assignee: Engineered Air Systems, Inc., St. Louis, Mo.

[21] Appl. No.: 243,071

[22] Filed: Mar. 12, 1981

[51] Int. Cl.[3] ..... F25D 17/06

[52] U.S. Cl. ..... 62/89; 62/263; 62/506

[58] Field of Search ..... 62/262, 263, 506, 507, 62/298, 89

[56] References Cited

U.S. PATENT DOCUMENTS

| | | | |
|---|---|---|---|
| 2,908,147 | 10/1959 | Powers | 62/262 |
| 2,971,347 | 2/1961 | Gygax | 62/507 |
| 3,306,066 | 2/1967 | Takada et al. | 62/262 |
| 3,566,585 | 3/1971 | Voloshen et al. | 126/299 D |

*Primary Examiner*—Ronald C. Capossela
*Attorney, Agent, or Firm*—Ralph B. Brick

[57] ABSTRACT

A method and arrangement for circulating condenser cooling air through the condenser section of an air conditioner used in dusty and windy environments. The condenser section includes an air cooled fin-tube type condenser secured across a straight duct extending vertically through the horizontal housing of the air conditioner. During operation of the air conditioner, an axial flow fan mounted within the duct draws ambient air into the duct through an opening in the bottom of the housing in a direction generally perpendicular to the natural wind flow in the vicinity of the air conditioner and directs the air through the condenser whereafter it is discharged to atmosphere.

3 Claims, 4 Drawing Figures

AIR CONDITIONER

BACKGROUND OF THE INVENTION

1. Field of the Invention

The present invention relates to air conditioners and in particular to the condenser section of an air conditioner to be used in a windy and dusty environment.

2. Description of the Prior Art

In the typical air conditioning unit, refrigerant is circulated through a condenser coil to dissipate heat generated in the cooling cycle to the atmosphere. As shown in U.S. Pat. No. 3,882,690, the condenser generally includes a plurality of refrigerant coils mounted within a plurality of spaced fins between which a stream of ambient air is circulated to carry away the heat in the refrigerant. While this type of arrangement has proven to be very reliable in normal circumstances, when it is used in desert areas where sand storms having winds of 20–80 mph are common, dust and sand tend to accumulate in the housing and between the fins and plug up the condenser, thus rendering it ineffective. Experience has indicated that one of the reasons this occurs is because the cooling air stream is turned as it flows through the condenser section of the air conditioner. More particularly, each time the air stream is turned or decreases velocity, some of the suspended particles in the flow are separated from it by inertial separation or settling so that after a period of time an accumulation of dust and dirt builds up in the condenser. In most areas this type of buildup has not been critical since the accumulations have been small and easily cleaned out during routine servicing of the unit. However, when this type of arrangement is used in desert areas where the air conditioner is often operated during sand storms, sand accumulates in the condenser very rapidly and requires daily, if not more frequent, cleaning of the condenser to assure its proper operation.

SUMMARY OF THE INVENTION

This invention pertains to an air conditioning unit to be used in a windy and dusty environment and a method for circulating ambient air through an air cooled refrigerant condenser in the unit.

The air conditioner includes a condenser section which includes a conventional air cooled tube-fin condenser which is secured across a relatively straight air duct extending vertically through the horizontal housing of the air conditioner. An axial flow fan is mounted within the duct which is adapted to draw ambient air into the duct through an inlet in the bottom of the housing and direct it through the condenser whereafter it is discharged to the atmosphere through an outlet in the top of the housing. This arrangement accommodates drawing the ambient air stream into the duct in a direction which extends generally perpendicular to the natural wind flow in the vicinity of the air conditioner to effect inertial separation of sand and other particulates suspended in the air as the air stream is turned into the duct. Additionally, the invention calls for spacing the condenser from the inlet of the duct to provide a settling chamber or section within the duct upstream from the condenser. This arrangement has been found to promote laminar flow in the air stream which allows the larger particulates to settle out of the air stream and drop to the ground while retaining the smaller particles in the air as it moves through the condenser and is discharged to the atmosphere.

From the foregoing, it can be seen that the invention contemplates an air conditioner which can be operated in a very windy and dusty environment; however, it is to be understood that various changes can be made in the arrangement, form, and construction of the apparatus disclosed herein without departing from the scope and spirit of the invention.

DESCRIPTION OF THE PREFERRED EMBODIMENT

Figure 1:
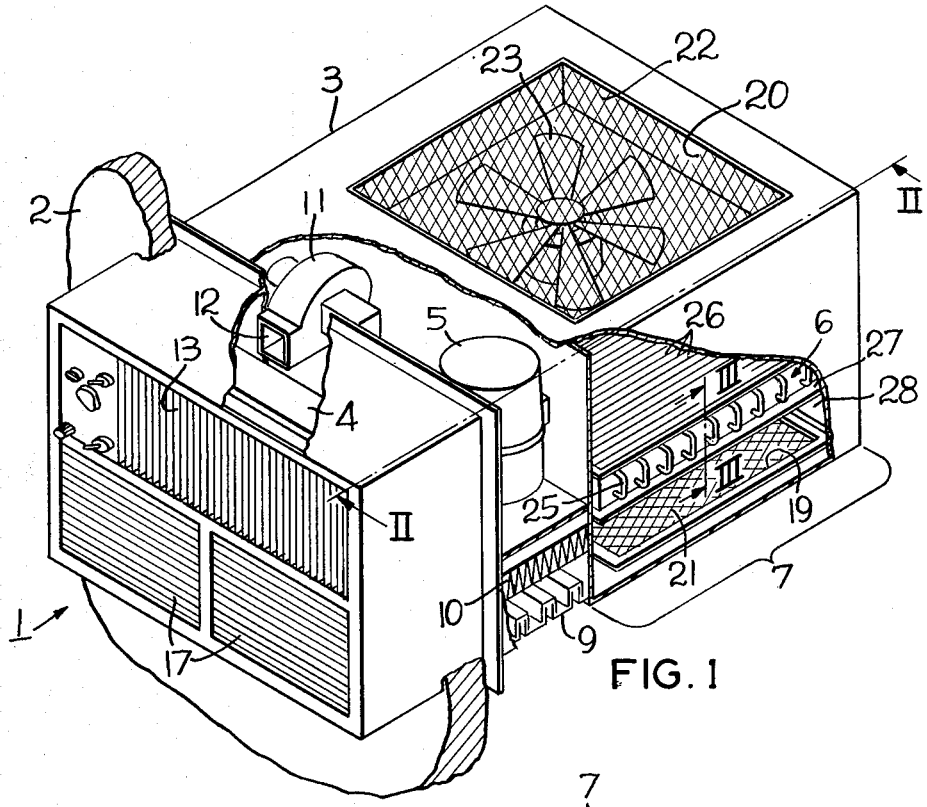
FIG. 1 is an isometric view, partially in section, showing the air conditioner embodying the invention.

As shown in FIG. 1, the air conditioner 1 embodying the invention is mounted on a wall or partition 2 of a personnel shelter or other enclosure. The air conditioner 1 has a generally rectangular horizontally disposed housing 3 enclosing a cooling or evaporating coil 4 and a compressor 5 connected to circulate refrigerant through an air-cooled condenser 6 mounted within the condenser section 7 as will be described.

As in the typical air conditioning unit, the air to be cooled is circulated through the evaporator coil 4 where it is cooled prior to being directed into the shelter. In the present embodiment, fresh air can be drawn directly from the atmosphere and cooled, or alternatively, recirculated from the shelter. More particularly, as shown by the arrows in FIGS. 2 and 3, fresh air can be drawn into a fresh air plenum 8 between fresh air inlet baffles 9 and through a particulate filter 10 by a fan 11 which in turn directs the clean air out of the outlet 12 and through the evaporator 4 whereafter it flows into the shelter through the cool air outlet 13. In this regard, it should be noted that the baffles 9 form a plurality of labyrinth-like passages 14 which effect inertial separation of sand and other particulate materials from the incoming fresh air stream. When it is desired to cool air recirculated from the shelter, the fan 11 is turned off and the outlet 12 closed off by a damper or the like (not shown). An evaporator fan 15 is then activated to draw air into a return air chamber 16 through a return air inlet 17 whereafter it is circulated through the evaporator coils 4 and discharged into the shelter through the cool air outlet 13.

Figure 2:
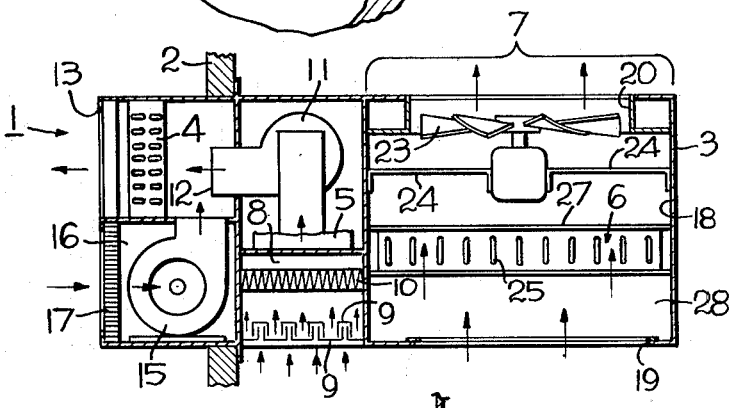
FIG. 2 is a vertical cross-sectional view taken substantially along line II—II in FIG. 1.
Figure 3:
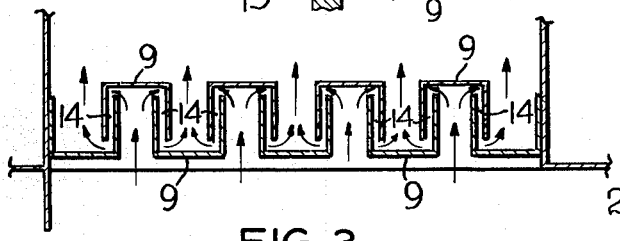
FIG. 3 is an enlarged cross-sectional view of the fresh air inlet passage.

The condenser section 7 includes a duct 18 extending vertically through the housing 3 which has an ambient air inlet 19 in the bottom of the housing and an ambient air outlet 20 in the top of the housing. The inlet and the outlet are covered by safety screens 21 and 22 to prevent foreign objects from getting into the duct. As shown in FIG. 2, an axial flow fan 23 is mounted within the duct 18 to draw a stream of ambient air into the duct through the inlet 19 and discharge it through the outlet 20. In the embodiment shown, the fan 23 is supported by a pair of brackets 24 secured to the walls of the duct 18.

Figure 4:
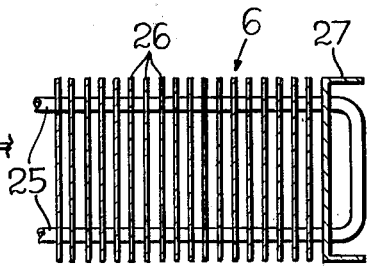
FIG. 4 is an enlarged cross-sectional view taken along line III—III in FIG. 1.

Referring to FIG. 4, the condenser 6 includes a plurality of tubes 25 adapted to circulate refrigerant through the condenser and a plurality of flat fin members 26 extending outwardly from the surface of the tubes in transversely spaced relation to one another. The condenser 6, which is of a conventional tube-fin construction mounted within a frame 27, is secured across the duct 18 by bolts or the like securing the frame 27 to the walls of the duct. As shown in the drawings, the condenser 6 is spaced from the air inlet 19 to provide a settling chamber 28 for the air stream within the duct between the condenser and the inlet. This arrangement has been found to promote laminar flow in the air stream immediately upstream from the condenser. This allows the larger particles to settle out of the air stream and drop to the ground through the inlet 19 while at the same time retaining the smaller particles in the air as it moves between the fins of the condenser and is discharged into the atmosphere through the outlet 20.

From the foregoing, it can be seen that during normal operation of the air conditioner, the fan 23 draws the ambient air stream into the settling chamber 28 in a direction substantially perpendicular to the direction of the natural wind flow in the vicinity of the air conditioner as shown by the flow arrow 10. This effectively turns the air stream in a direction normal to its direction of ambient flow as it is drawn into the settling chamber to promote inertial separation of particulate materials from the air stream as it is drawn toward the settling chamber. In practice, this has been found to be most effective when the fan 23 is sized to maintain the velocity of the air stream at the air inlet 19 in the range of 350 to 500 feet per minute. Under these conditions, the air stream tends to develop laminar flow characteristics as it approaches the condenser in the settling chamber. Thus, as noted above, larger particulates settle out of the air stream in the settling chamber and fall to the ground while the remaining particulates are carried through the condenser and out of the air conditioner in the air stream.

The embodiments of the invention in which an exclusive property or privilege is claimed are defined as follows:

1. A method for providing condenser cooling air to an air conditioner having a solids settling chamber in substantially straight flow-through communication with an air cooled condenser aligned above the settling chamber during operation of the air conditioner in a windy and dusty environment comprising:

drawing an air stream of ambient air vertically upward into a confined, uniformly sized settling chamber in a direction substantially perpendicular to the direction of the natural wind flow in a straight laminar path for a preselected distance at a velocity in the range of 350 feet to 500 feet per minute sufficient to permit settlement of particulate dust matter entrained in said air stream; and circulating the air stream through the condenser and out of the air conditioner in substantially the same vertical, laminar path as the flow of air passing through the settling chamber.

2. In an air conditioner having an outer housing and an air cooled refrigerant condenser, the improvement comprising:

a relatively straight air duct aligned to extend vertically through the housing in a direction substantially perpendicular to the natural wind flow;

said duct having an aligned ambient air inlet at its lower end and an ambient air outlet at its upper end;

fan means secured in said duct between said condenser and said air outlet to draw an ambient air stream into the duct through said inlet and direct it out of the duct through said outlet;

means securing the refrigerant condenser across the interior of the duct in flow-through heat transfer relation with the ambient air stream; and said condenser being spaced from the inlet to provide a uniformly sized solids settling chamber within the duct between the inlet and the condenser to promote laminar flow in the air stream flowing through the duct.

3. The improvement according to claim 2, and flow-through evaporator means operatively connected with the condenser;

fresh air plenum means connected with said evaporator means for circulating air to be cooled through the evaporator means; and said plenum means having fresh air inlet means including a plurality of labyrinth passages opening to the atmosphere to accommodate a flow of ambient air into the plenum means while effecting inertial separation of particulates suspended in said air.

* * * * *